US009884744B2

(12) United States Patent
Witczak et al.

(10) Patent No.: US 9,884,744 B2
(45) Date of Patent: Feb. 6, 2018

(54) ROPELESS HIGH-RISE ELEVATOR INSTALLATION APPROACH

(71) Applicant: Otis Elevator Company, Farmington, CT (US)

(72) Inventors: Tadeusz Witczak, Lodz (PL); Martin J. Hardesty, West Hartford, CT (US); Zbigniew Piech, Cheshire, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/101,220

(22) PCT Filed: Dec. 5, 2013

(86) PCT No.: PCT/US2013/073325
§ 371 (c)(1),
(2) Date: Jun. 2, 2016

(87) PCT Pub. No.: WO2015/084371
PCT Pub. Date: Jun. 11, 2015

(65) Prior Publication Data

US 2016/0304317 A1 Oct. 20, 2016

(51) Int. Cl.
*B66B 11/04* (2006.01)
*B66B 9/00* (2006.01)
(Continued)

(52) U.S. Cl.
CPC ..... *B66B 9/003* (2013.01); *B66B 9/02* (2013.01); *B66B 11/04* (2013.01); *B66B 11/0407* (2013.01); *B66B 19/00* (2013.01)

(58) Field of Classification Search
CPC ..... B66B 19/00; B66B 9/003; B66B 11/0407
See application file for complete search history.

(56) References Cited

U.S. PATENT DOCUMENTS 5,183,980 A * 2/1993 Okuma ..... B66B 11/0407 187/250
5,288,956 A * 2/1994 Kadokura ..... B66B 11/0407 187/250
(Continued)

FOREIGN PATENT DOCUMENTS

CN 1962387 A 5/2007
CN 1990372 A 7/2007
(Continued)

OTHER PUBLICATIONS

English Machine Translation of JP 2875112 (JPH 060348).*
(Continued)

*Primary Examiner* — William E Dondero
*Assistant Examiner* — Diem M Tran
(74) *Attorney, Agent, or Firm* — Cantor Colburn LLP

(57) ABSTRACT

A method (160) for constructing a building (92) with an elevator system (20) is disclosed. The method (160) may include forming a first hoistway (22) for the elevator system (20) within two adjacent levels (82, 84) of the building (92), installing a first stationary part (54) of a first linear permanent magnet motor within the first hoistway (22), placing a first elevator car (24) within the first hoistway (22), mounting a first moving part (52) of the first linear permanent magnet motor on the first elevator car (24), and using the first stationary part (54) and the first moving part (52) of the first linear permanent magnet motor to generate a vertical thrust force to move the first elevator car (24) within the first hoistway (22), the first elevator car (24) carrying at least one of passengers, equipment and materials for construction of upper levels of the elevator system (20) and the building (92).

14 Claims, 11 Drawing Sheets

(51) Int. Cl.
*B66B 19/00* (2006.01)
*B66B 9/02* (2006.01)

(56) References Cited

U.S. PATENT DOCUMENTS

| | | | | |
|---|---|---|---|---|
| 6,955,245 | B2 * | 10/2005 | Dunser | B66B 1/2466 187/249 |
| 7,665,582 | B2 | 2/2010 | Lindh | |
| 2016/0046464 | A1 * | 2/2016 | Piech | B66B 9/003 187/249 |
| 2017/0036889 | A1 * | 2/2017 | Ericson | B66B 7/025 |
| 2017/0057790 | A1 * | 3/2017 | Roberts | B66B 11/0273 |

FOREIGN PATENT DOCUMENTS

| | | | | |
|---|---|---|---|---|
| CN | 101535165 | A | 9/2009 | |
| CN | 103025640 | A | 4/2013 | |
| CN | 103303771 | A | 9/2013 | |
| EP | 0499254 | A1 | 8/1992 | |
| JP | H04159993 | A | 6/1992 | |
| JP | H04213581 | A | 8/1992 | |
| JP | 2875112 | B2 * | 3/1999 | |
| JP | 2004161468 | A | 6/2004 | |
| WO | WO 2008136692 | A2 * | 11/2008 | B66B 9/02 |
| WO | 2012045606 | A1 | 4/2012 | |
| WO | 2012154178 | A1 | 11/2012 | |
| WO | WO 2014123515 | A1 * | 8/2014 | B66B 9/02 |
| WO | WO 2016126933 | A1 * | 8/2016 | B66B 19/00 |
| WO | WO 2016207136 | A1 * | 12/2016 | B66B 7/044 |

OTHER PUBLICATIONS

International Search Report for application PCT/US2013/073325, dated Sep. 3, 2014, 12 pages.
CN First Office Action and English Translation; Application No. CN 201380082010.8; dated Aug. 1, 2017; 10 pages.

* cited by examiner

ROPELESS HIGH-RISE ELEVATOR INSTALLATION APPROACH

FIELD OF DISCLOSURE

The present disclosure relates generally to elevators and, more particularly, to self-propelled elevator systems.

BACKGROUND OF THE DISCLOSURE

Self-propelled elevator systems, including ropeless elevator systems, are useful in certain applications, such as, high rise buildings, where the mass of the ropes for a conventional roped elevator system is prohibitive and it is beneficial to have multiple elevator cars in a single shaft. In self-propelled elevator systems, a first hoistway may be designated for upward travel of the elevator cars, and a second hoistway may be designated for downward travel of the elevator cars. In addition, transfer stations may be used to move the elevator cars horizontally between the first and second hoistways.

SUMMARY OF THE DISCLOSURE

An exemplary embodiment of the present invention is directed to a method for constructing a building with an elevator system. The method may include forming a first hoistway for the elevator system within two adjacent levels of the building, installing a first stationary part of a first linear permanent magnet motor within the first hoistway, placing a first elevator car within the first hoistway, mounting a first moving part of the first linear permanent magnet motor on the first elevator car, and using the first stationary part and the first moving part of the first linear permanent magnet motor to generate a vertical thrust force to move the first elevator car within the first hoistway. The first elevator car may carry at least one of passengers, equipment and materials for construction of upper levels of the elevator system and the building.

Another exemplary embodiment of the present invention is directed to a ropeless elevator system. The exemplary ropeless elevator system may comprise a first elevator hoistway, a second elevator hoistway, a plurality of elevator cars configured to travel in at least one of the first and second elevator hoistways, and an elevator propulsion system. The elevator propulsion system may comprise at least one first stationary portion positioned in the first elevator hoistway, at least one second stationary portion positioned in the second elevator hoistway, and a plurality of moving portions. The plurality of moving portions may be selectively operatively connected to the plurality of elevator cars. The plurality of moving portions selectively operatively connected to the plurality of elevator cars may interact with at least one of the first and second stationary portions to provide a motive force to move the plurality of elevator cars within at least one of the first and second elevator hoistways. At least two of the plurality of elevator cars may be operatively connected to each other such that the moving portions selectively operatively connected to the at least two of the plurality of elevator cars are provided a combined motive force by the moving portions selectively operatively connected thereto.

Another exemplary embodiment of the present disclosure is directed to a method for operating a ropeless elevator system. The ropeless elevator system may include a first hoistway, a second hoistway, an upper transfer station positioned above the first and second hoistways, and a lower transfer station positioned below the first and second hoistways. The method may comprise circulating a plurality of elevator cars in a loop around the first hoistway, the upper transfer station, the second hoistway, and the lower transfer station; stopping circulation of the plurality of elevator cars in the loop; coupling two elevator cars together; and moving the coupled elevator cars upwards or downwards within the first and second hoistways.

Although various features are disclosed in relation to specific exemplary embodiments, it is understood that the various features may be combined with each other, or used alone, with any of the various exemplary embodiments without departing from the scope of the disclosure. For example, the carrying at least one of passengers, equipment and materials for construction of upper levels of the elevator system and the building may be performed prior to completion of the elevator system. The method may further comprise forming a second hoistway for the elevator system next to the first hoistway; installing a second stationary part of a second linear permanent magnet motor within the second hoistway; placing a second elevator car within the second hoistway; mounting a second moving part of the second linear permanent magnet motor on the second elevator car; and coupling the first and second elevator cars together such that they share an interior compartment.

In another example, the method may further comprise installing an oversized elevator car in the first and second hoistways, and utilizing the first and second linear permanent magnet motors to provide a thrust force to move the oversized elevator car vertically within the first and second hoistways. An extended moving part of the linear permanent magnet motor may be incorporated to generate a greater thrust force. The method may further comprise utilizing a plurality of elevator cars within the first hoistway. In another example, the method may further comprise installing at least one additional elevator car in the first hoistway, and operatively coupling the at least one additional elevator car to the first elevator car. The method may further comprise utilizing a top or bottom surface of the first elevator car to transport loads within the first hoistway. The method may further comprise mounting an extended platform on top of the first elevator car.

In another example, the moving portions selectively operatively connected to the at least two of the plurality of elevator cars operatively connected to each other may be synchronized with each other in order to move the elevator cars at a same speed and direction. The ropeless elevator system may further comprise an oversized elevator car that is larger than the first elevator car or the second elevator car, and the elevator propulsion system may include moving portions selectively operatively connected to the oversized elevator car. The interaction of the moving portions selectively operatively connected to the oversized elevator car and the stationary portions positioned in the first and second hoistways may generate a thrust force to move the oversized elevator car in a vertical direction within the first and second hoistways may generate a thrust force to move the oversized elevator car in a vertical direction within the first and second hoistways.

In another example, the ropeless elevator system may further comprise an upper transfer station positioned at or above a top level of the first and second hoistways, and a lower transfer station positioned at or below a bottom level of the first and second hoistways. The plurality of elevator cars may operate in a loop within the first hoistway, the upper transfer station, the second hoistway, and the lower transfer station when the plurality of elevator cars are not connected to each other. The elevator cars may operate bi-directionally within the first and second hoistways when the at least two of the plurality of elevator cars are operatively connected to each other.

In other examples, the method may further comprise synchronizing motors of the coupled elevator cars together such that the coupled elevator cars move at a same speed and direction. The method may further comprise carrying loads on top of or beneath the elevator cars. The method may further comprise hanging a load from a bottom surface of one of the plurality of elevator cars. The method may further comprise inserting a cargo car within the first and second hoistways, the cargo car having a size that is greater than a size of one elevator car, and moving the cargo car upwards or downwards within the first and second hoistways.

These and other aspects and features will become more readily apparent upon reading the following detailed description when taken in conjunction with the accompanying drawings.

While the present disclosure is susceptible to various modifications and alternative constructions, certain illustrative embodiments thereof will be shown and described below in detail. The invention is not limited to the specific embodiments disclosed, but instead includes all modifications, alternative constructions, and equivalents thereof

DETAILED DESCRIPTION

Figure 1:
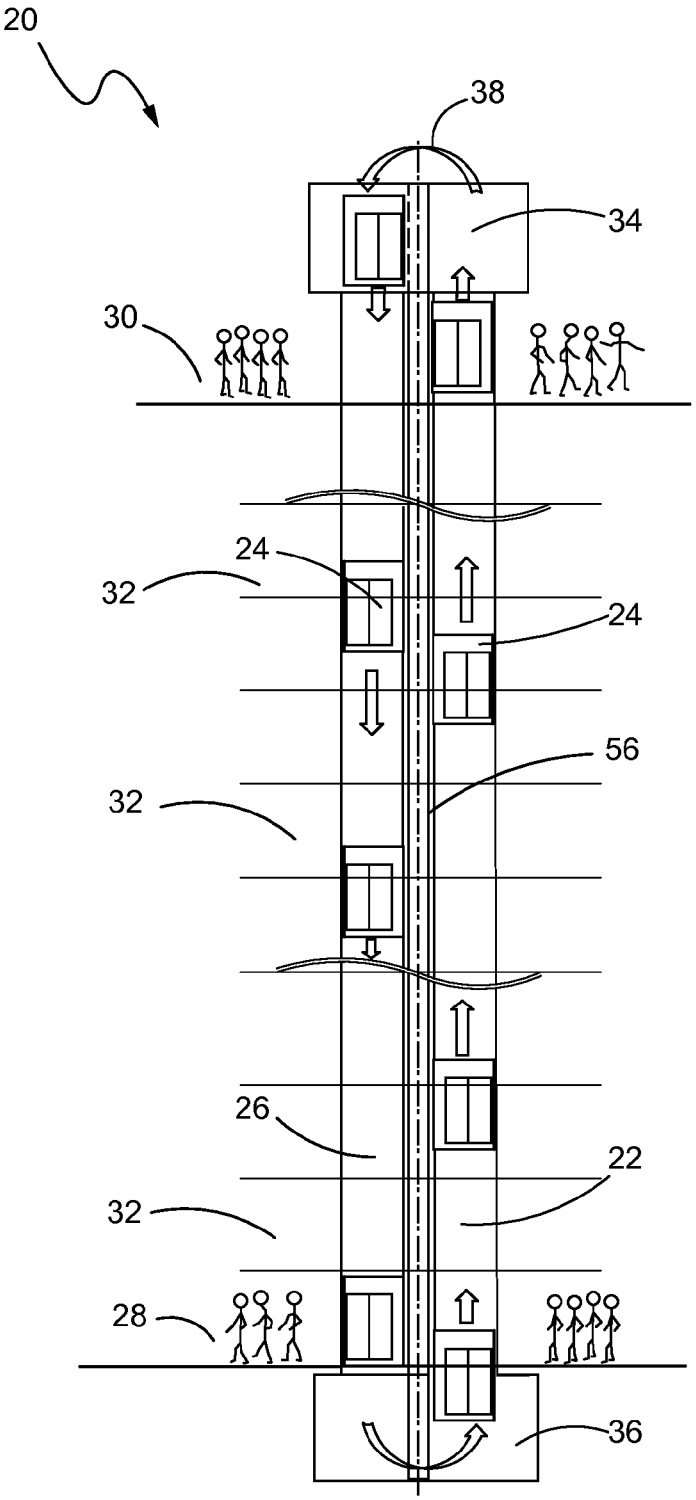
FIG. 1 depicts an elevator system according to an exemplary embodiment.
Figure 2:
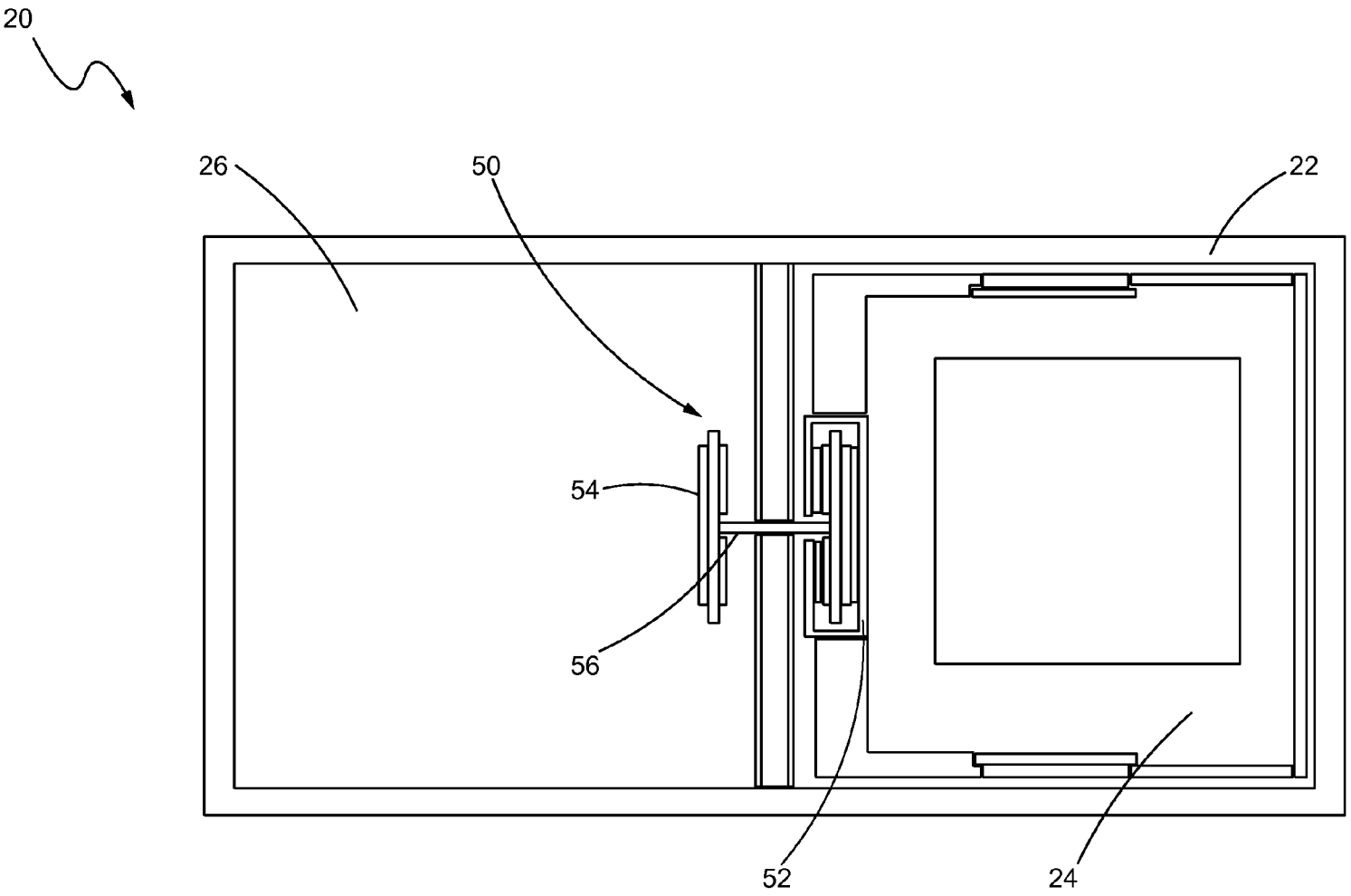
FIG. 2 is a top down view of an elevator car in a hoistway in an exemplary embodiment.
Figure 4:
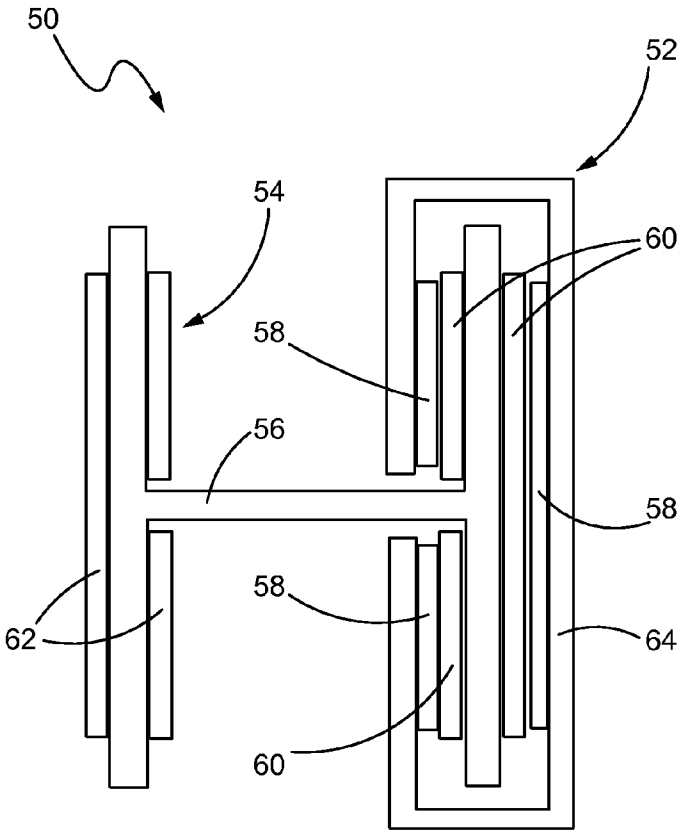
FIG. 4 is a top down view of a stationary portion and a moving portion of a propulsion system in an exemplary embodiment.
Figure 3:
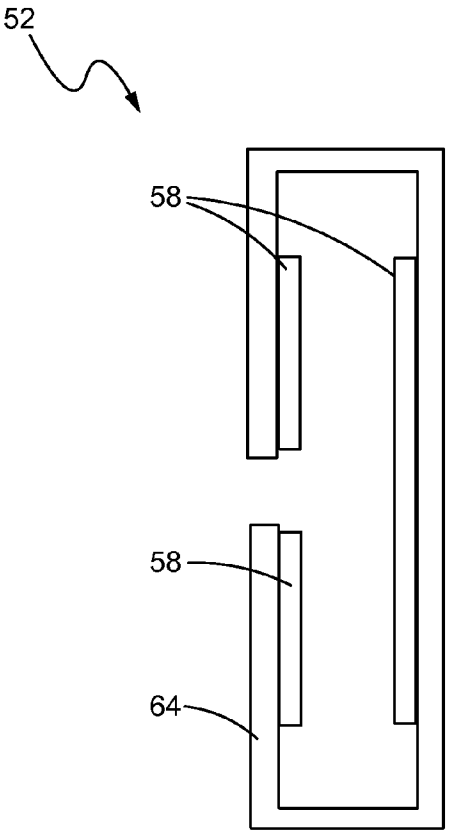
FIG. 3 is a top down view of a moving portion of a propulsion system in an exemplary embodiment.
Figure 5:
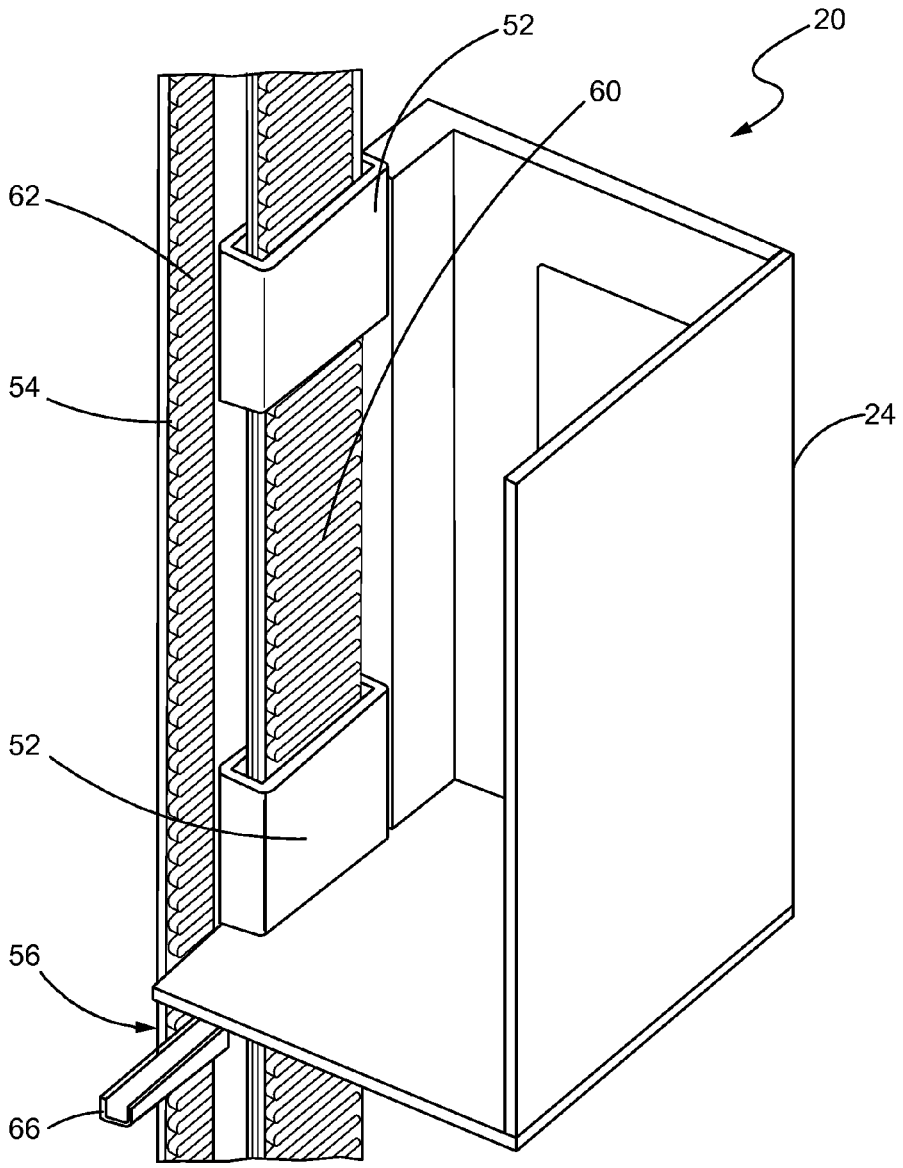
FIG. 5 is a perspective view of an elevator car and a propulsion system in an exemplary embodiment.

FIG. 1 depicts an elevator system 20 in an exemplary embodiment. This elevator system 20 is shown for illustrative purposes to assist in disclosing various embodiments of the invention. As is understood by a person skilled in the art, FIG. 1 does not depict all of the components of an exemplary elevator system, nor are the depicted features necessarily included in all elevator systems.

As shown in FIG. 1, the elevator system 20 includes a first hoistway 22 in which a plurality of elevator cars 24 travel upward and a second hoistway 26 in which the plurality of elevator cars 24 travel downward. Elevator system 20 transports elevator cars 24 from a first floor 28 to a top floor 30 in first hoistway 22, and transports elevator cars 24 from the top floor 30 to the first floor 28 in second hoistway 26. Although not shown, elevator cars 24 may also stop at intermediate floors 32 to allow ingress to and egress from an elevator car intermediate the first floor 28 and top floor 30.

Positioned across the first and second hoistways 22, 26 above the top floor 30 is an upper transfer station 34. Upper transfer station 34 imparts horizontal motion to elevator cars 24 to move the elevator cars 24 from the first hoistway 22 to the second hoistway 26. It is understood that upper transfer station 34 may be located at the top floor 30, rather than above the top floor 30. Positioned across the first and second hoistways 22, 26 below the first floor 28 is a lower transfer station 36. Lower transfer station 36 imparts horizontal motion to elevator cars 24 to move the elevator cars 24 from the second hoistway 26 to the first hoistway 22. It is to be understood that lower transfer station 36 may be located at the first floor 28, rather than below the first floor 28.

Together, the first hoistway 22, the upper transfer station 34, the second hoistway 26, and the lower transfer station 36 comprise a loop 38 in which the plurality of cars 24 circulate to the plurality of floors 28, 30, 32 and stop to allow the ingress and egress of passengers to the plurality of floors 28, 30, 32.

Turning now to FIGS. 2-5, with continued reference to FIG. 1, elevator system 20 includes a propulsion system 50 disposed on the elevator cars 24, in the hoistways 22, 26, and in the transfer stations 34, 36, 42. The propulsion system 50 imparts vertical motion to elevator cars 24 to propel the elevator cars from one level to the next within the hoistways 22, 26 and into and out of the transfer stations 34, 36, 42. Different types of motors can be used for the propulsion system 50, such as, but not limited to, a linear permanent magnet motor, a flux switching motor, an induction motor, a friction motor, or the like. The propulsion system 50 may comprise a moving part 52 mounted on each elevator car 24 and a stationary part 54 mounted to a structural member 56 positioned within the hoistways 22, 26 and transfer stations 34, 36, 42. The interaction of the moving part 52 and the stationary part 54 generates a thrust force to move the elevator cars 24 in a vertical direction within the hoistways 22, 26 and transfer stations 34, 36, 42.

In an example, the moving part 52 includes permanent magnets 58, and the stationary part 54 includes windings 60, 62 mounted on structural member 56. Permanent magnets 58 may be attached to a support element 64 of the moving part 52, with the support element 64 coupled to the elevator car 24. Structural member 56 may be made of a ferromagnetic material and coupled to a wall of the first and/or second hoistways 22, 26 by support brackets 66. Windings 60, 62 may be formed about structural member 56. Windings 60 provide the stationary part of the propulsion system within the first hoistway 22, and windings 62 provide the stationary part of the propulsion system within the second hoistway 26. A support element 64 of the moving part 52 may be positioned about windings 60, 62 such that the windings 60, 62 and permanent magnets 58 are adjacent.

Windings 60 in the first hoistway 22 are energized by a power source (not shown) to propel one or more elevator cars 24 upward in the first hoistway 22 and transfer stations 34, 36, 42. When a voltage is applied to windings 60, the interaction between the windings 60 and permanent magnets 58 impart motion to the elevator car 24. Windings 62 in the second hoistway 26 operate as a regenerative brake to control descent of the elevator car 24 in the second hoistway 26 and transfer stations 34, 36, 42. Windings 62 also provide a current back to the drive unit, for example, to recharge an electrical system.

Figure 6:
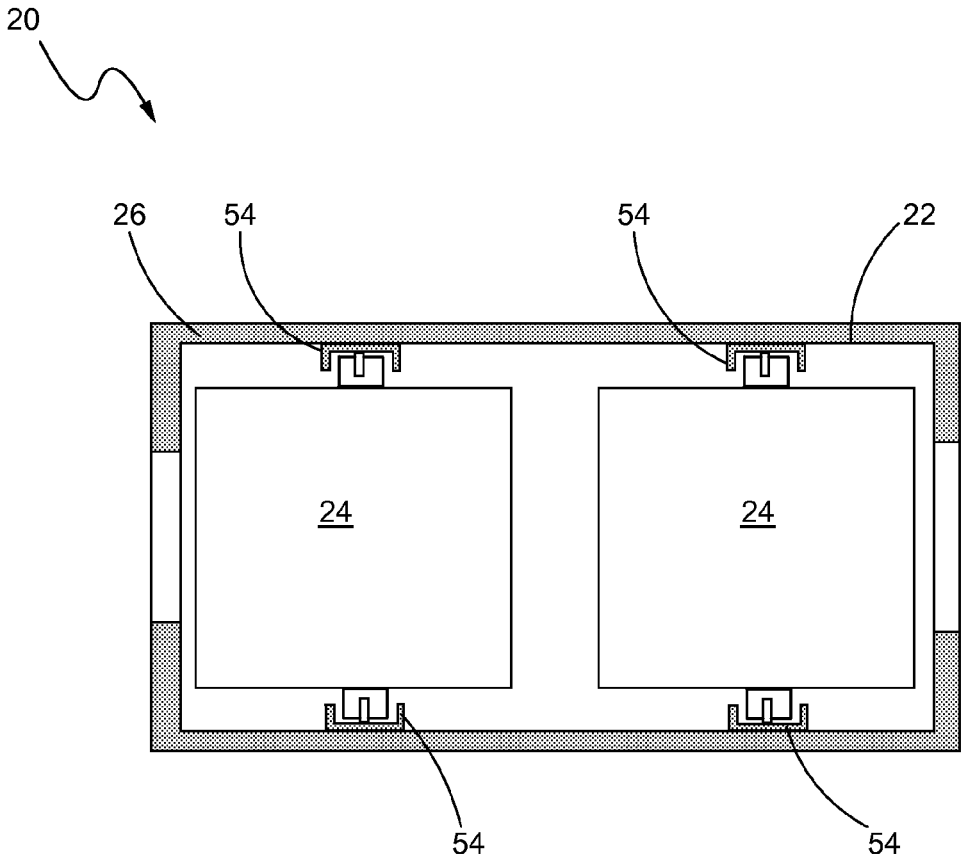
FIG. 6 is a top down view of two elevator cars in two hoistways in an exemplary embodiment.

Other configurations and locations for the propulsion system 50 may be used. For example, as shown in FIG. 6, the elevator system 20 has four stationary parts 54, two for each of the first and second hoistways 22, 26. The stationary parts 54 are positioned in each hoistway at two opposite sidewalls of each hoistway 22, 26. Elevator cars 24 include at least one moving part of the propulsion system for each stationary part of the propulsion system, as described above. Other configurations and locations for the propulsions system may be used.

Figure 7:
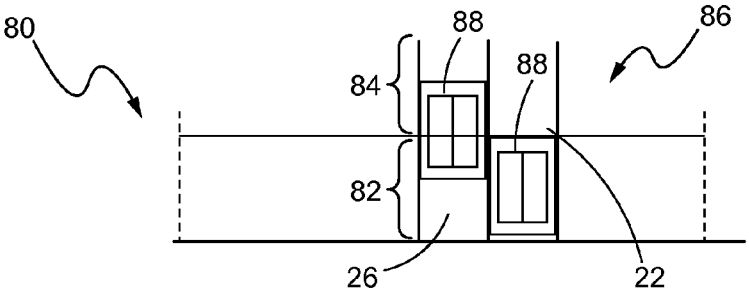
FIG. 7 is a schematic representation of a partially constructed building with two levels of an elevator system installed in an exemplary embodiment.

In another exemplary embodiment, the elevator system 20 can be used during construction at an early stage of installation. FIG. 7 depicts a partially constructed building 80 having two levels 82, 84 of an elevator system 86 installed. With at least two adjacent levels 82, 84 of the elevator system 86 installed, construction workers can start using the elevator system 86 to build upper levels of both the elevator system 86 and the building 80. Once the stationary part of the propulsion system is installed in the hoistway, and the moving part of the propulsion system is mounted to the elevator car, the elevator system 84 is functional and ready to be used. For example, workers, equipment, and materials for construction of the upper levels of the elevator system 86 and building 80 may be carried from the first level 82 to the second level 84 within the elevator cars 88 using the partially installed elevator system 86.

Figure 8:
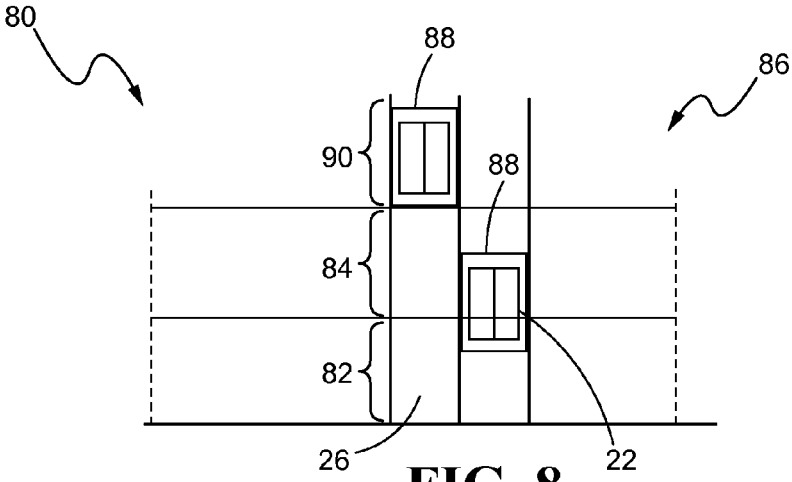
FIG. 8 is a schematic representation of a partially constructed building with three levels of an elevator system installed in an exemplary embodiment.

As shown best in FIG. 8, after the construction equipment and materials are loaded on the second level 84, workers can use them to build a third level 90 of the elevator system 86, as well as other parts of the building 80. After the third level 90 of the elevator system 86 is built, more materials, equipment, and workers for construction of the upper levels of the elevator system 86 and building 80 may be carried from the first level 82 or second level 84 to the third level 90 within the elevator cars 88 using the partially installed elevator system 86. After each successive level of the elevator system 86 is built, it can be immediately used to construct the next level of the elevator system and/or building. The partially completed elevator system 86 can be used for installation of all the upper levels of the elevator system and building.

Figure 9:
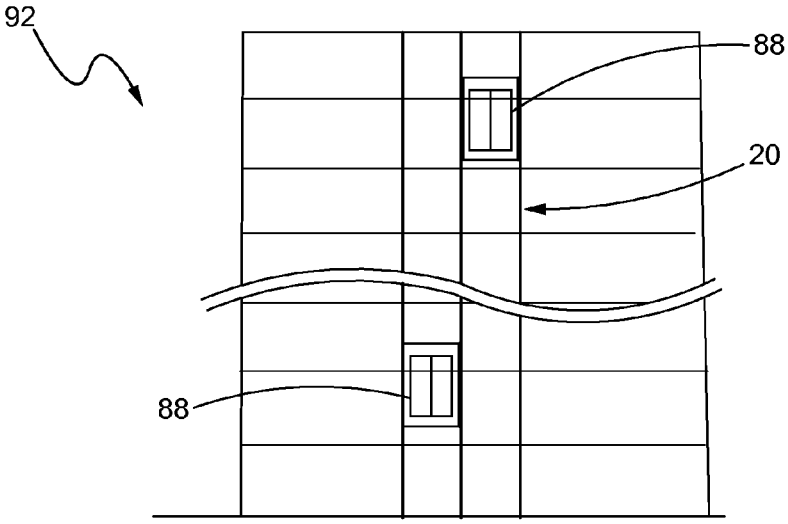
FIG. 9 is a schematic representation of a building with an elevator system after final construction in an exemplary embodiment.

In addition, as shown best in FIG. 9, when construction of the entire elevator system 20 and building 92 is finished, minimal labor is needed to convert the elevator system 20 from construction utilization to the expected passenger utilization. For example, the elevator cars 88 may be cleaned and refurbished, or replaced with new, polished ones, and the structure and stationary part within the hoistways of the elevator system 20 remain the same as that used during construction. The moving part may also be re-used, either staying on the elevator cars 88 that remain in the elevator system 20, or taken off the elevator cars 88 and mounted on new elevator cars for use in the elevator system 20. Thus, the moving part, stationary part and hoistway are part of a final construction of the elevator system 20 of the building 92, with the elevator system used during construction being permanent, not temporary. The term "final construction of the elevator system," as used herein, is defined as the complete, fully-installed elevator system in the building.

Figure 10:
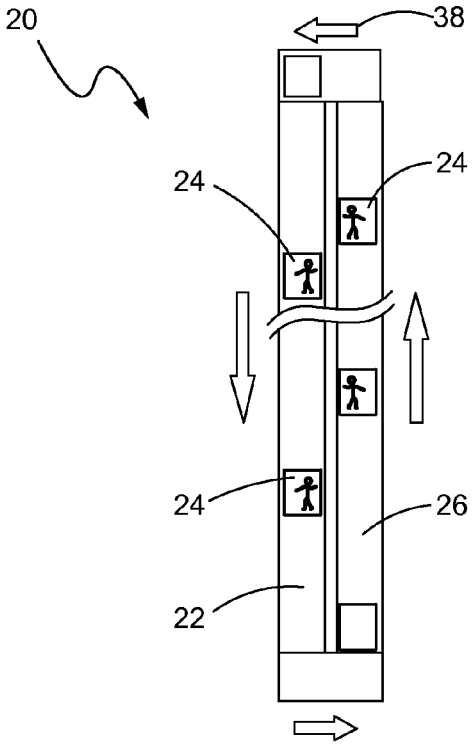
FIG. 10 is a schematic representation of an elevator system in which elevator cars circulate in a loop in an exemplary embodiment.
Figure 11:
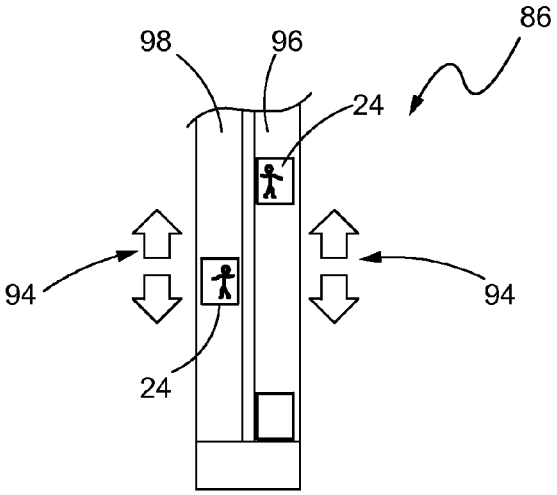
FIG. 11 is a schematic representation of an elevator system in which elevator cars move bi-directionally in an exemplary embodiment.

In order to build an elevator system 20 where the elevator cars 24 circulate in a loop 38 to the plurality of floors, as described above and shown schematically in FIG. 10, at least two hoistways 22, 26 are installed in the building. As shown schematically in FIG. 11, during construction with partial installation of the elevator system 86, the elevator cars 24 can operate bi-directionally, represented by arrows 94. For example, a control system or control units of the elevator cars 24 may be programmed to move the elevator cars 24 in both the upward and downward directions within each of the hoistways 96, 98. More than one elevator car 24 may be used within each hoistway 96, 98 to allow construction workers to work on different levels of the partially constructed building, having multiple elevator cars at their convenience. After final construction of the elevator, the control system can then be programmed to operate the elevator cars 24 in a loop within the hoistways 96, 98.

Figure 12:
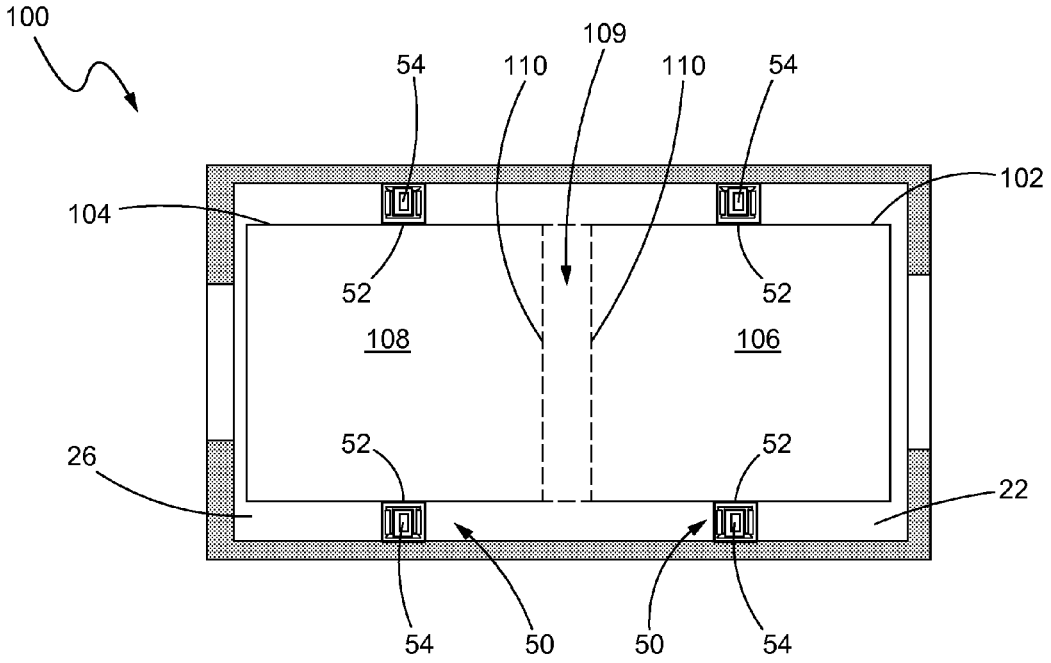
FIG. 12 is a top down view of two elevator cars coupled together in two hoistways in an exemplary embodiment.

In order to increase a size of the load carried by the elevator cars, two or more elevator cars can be coupled together within one or more hoistways. For example, referring now to FIG. 12, with continued reference to FIGS. 1-11, therein is illustrated an elevator system 100 in another exemplary embodiment. The elevator system 100 includes a first elevator car 102 positioned within the first hoistway 22 and a second elevator car 104 positioned within the second hoistway 26. The elevator system 100 further includes moving parts 52 of the propulsion system 50 mounted on the elevator cars 102, 104 and stationary parts 54 of the propulsion system disposed in the hoistways 22, 26. The first elevator car 102 includes a first interior compartment 106, and the second elevator car includes a second interior compartment 108.

Each of the first and second elevator cars 102, 104 also includes intervening walls 110, which are adjustable. As used herein, the term "intervening walls" is defined as the walls that lie between the first elevator car 102 and the second elevator car 104. The intervening walls 110 can be adjusted or removed in order to allow a coupling of the first and second elevator cars 102, 104 together and a joining of the first and second interior compartment 106, 108. This results in a larger interior compartment 109, which may be used to lift and carry greater loads, such as, larger equipment (e.g., forklifts and cement mixers), larger materials (e.g., dry wall, transformers, and air conditioning units), and an increased number of construction workers.

When coupled together, the first and second elevator cars 102, 104 have a joined interior compartment 109 that is greater than (e.g. double) the size of each of the first and second interior compartments 106, 108. This may be beneficial when using the elevator system during construction, and also, after final construction of the elevator system, to carry greater loads, such as, large-sized objects that do not fit inside each of the first and second interior compartments 106, 108. The moving parts 52 and stationary parts 54 on the first and second elevator cars 102, 104 are synchronized with each other in order to move the first and second elevator cars 102, 104 at a same speed and direction within the hoistways 22, 26. The control system and control units may then operate the coupled elevator cars 102, 104 bi-directionally (upwards and downwards) within the first and second hoistways 22, 26. It is to be understood that the elevator cars may be coupled in other configurations than that shown and described in FIG. 12. For example, two elevator cars in the first hoistway 22 may be coupled with two elevator cars in the second hoistway 26, three elevator cars in one hoistway may be coupled together, three elevator cars in three separate hoistways may be coupled together, etc.

Figure 13:
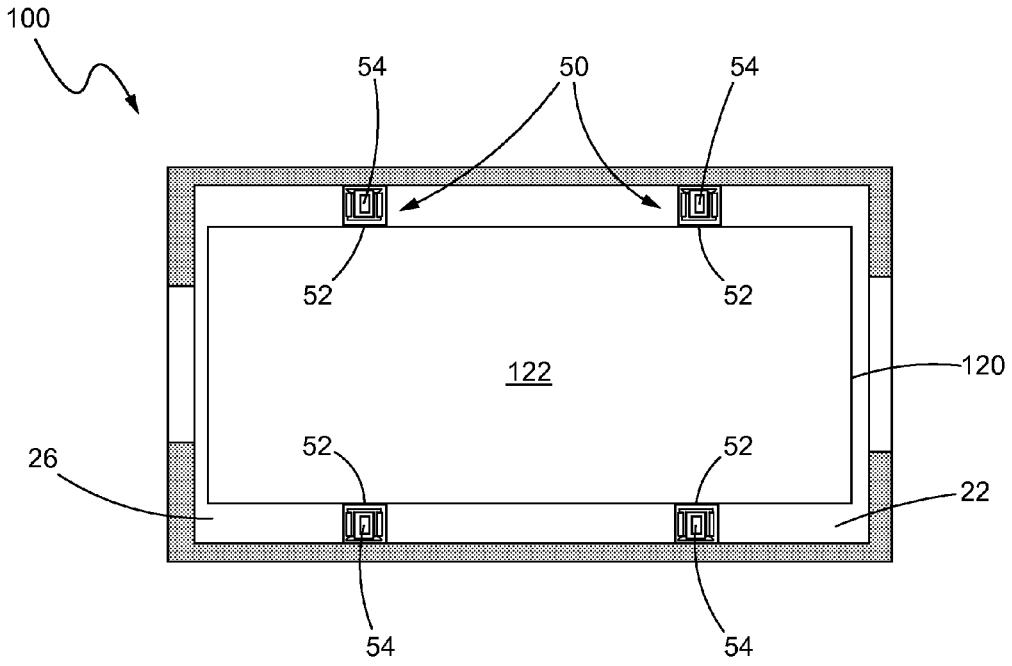
FIG. 13 a top down view of a cargo car in two hoistways in an exemplary embodiment.
Figure 14:
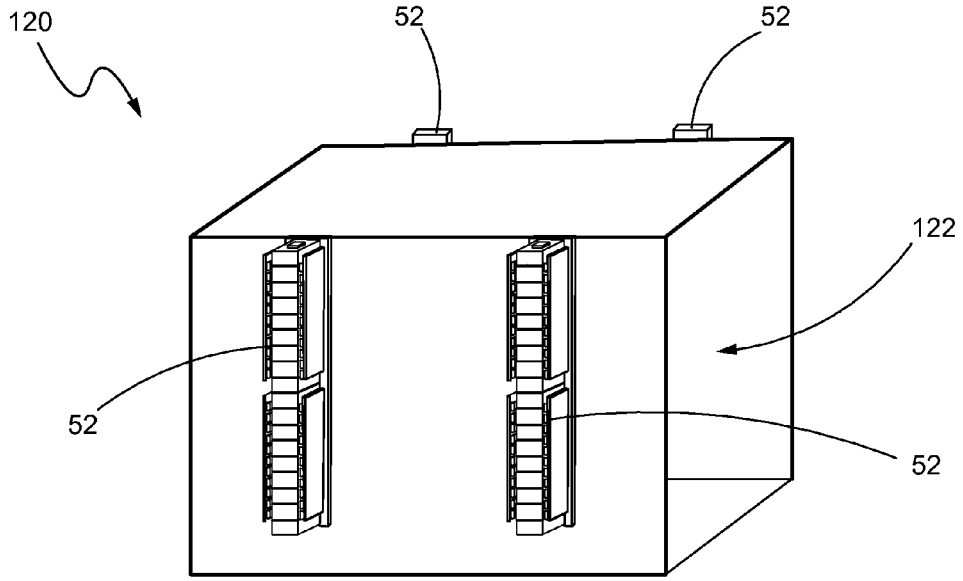
FIG. 14 is a perspective view of the cargo car of FIG. 13.

As shown in FIGS. 13 and 14, elevator system 100 may have a cargo car 120 positioned within the first and second hoistways 22, 26. The cargo car 120 may be oversized, or larger than each of the first and second elevator cars 102, 104, spanning across both the first and second hoistways 22, 26. For example, the cargo car 120 may be double the size of each of the first and second elevator cars 102, 104 and may have an interior compartment 122 which is double the size of each of the first and second interior compartments 106, 108. Additionally, the cargo car 120 or elevator car 24 may be designed to carry a greater load, such as, by having a lighter construction or decreasing a weight of the cargo car 120 or elevator car 24.

Moving parts 52, mounted on the cargo car 120, interact with the stationary parts 54 disposed in the first and second hoistways 22, 26 to generate a thrust force to move the cargo car 120 in a vertical direction within the hoistways 22, 26. The control system and control unit may operate the cargo car 120 such that it moves bi-directionally (upwards and downwards) within the first and second hoistways 22, 26. In order to use the cargo car 120, other elevator cars may have to be removed from the first and second hoistways 22, 26. The cargo car may carry people and large-sized objects, which do not fit inside each of the first and second interior compartments 106, 108 during construction and after final construction.

According to another embodiment, loads may be carried through the hoistways to different floors of the building on top of, beneath, or outside the elevator cars 24 or cargo car 120, such as on a top or bottom surface of the elevator cars 24 or cargo car 120. Loading cargo, materials, equipment, and other large-sized objects on top of or beneath the elevator cars may be beneficial if it does not fit inside the elevator cars. For example, an extended platform may be mounted on top of an elevator car 24, coupled elevator cars 102, 104, or cargo car 120, or a roof of the elevator may be extended, in order to place large-sized objects on top of the elevator car. In another example, objects may hang below the elevator cars 24, 102, 104, 120, such as, via a hook, ropes, or harnesses attached to a bottom surface of the elevator cars.

In order to generate a greater thrust force to support an increased weight load within elevator cars 24, coupled elevator cars 102, 104, or cargo car 120, the propulsion system 50 of the elevator system 20 may be extended. The moving part 52, which may include permanent magnets or windings, may be increased. For example, a moving part with an extended length, depth, and/or thickness may be mounted on the elevator cars 24, 102, 104, 120. In another embodiment, two or more elevator cars may be connected (with or without joining interior compartments) to combine motor power and generate a greater thrust force. For example, a first elevator car may be connected above or below a second elevator car with a heavy load, to help pull or push the second elevator car through the hoistway. The two elevator cars may be connected via a mechanical connection, electromagnetic connection, or the like. The capacity to carry increased weight loads within the hoistways 22, 26 is beneficial during construction of the elevator system and building, as well as after final construction.

Figure 15:
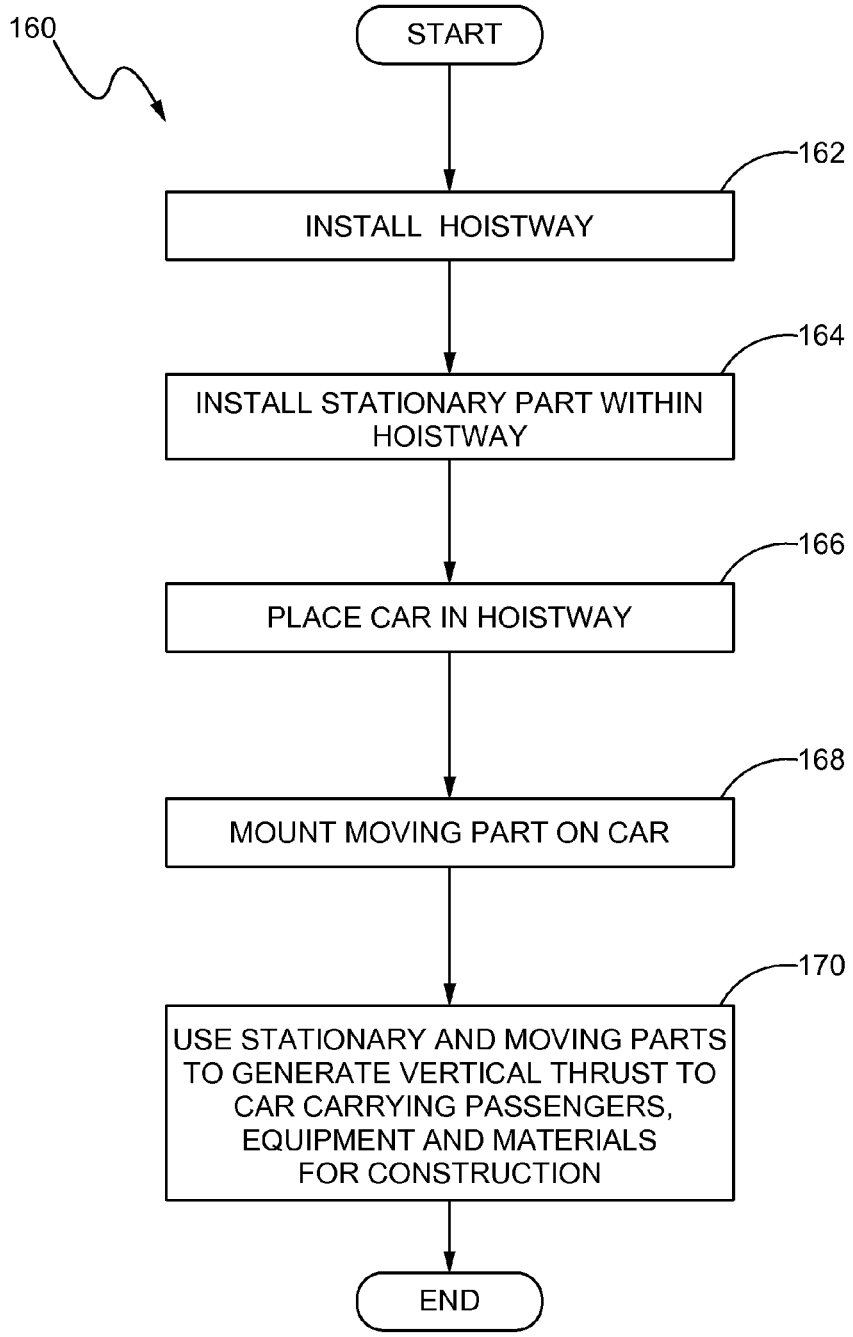
FIG. 15 is a flowchart illustrating an exemplary process for constructing a building with an elevator system in an exemplary embodiment.

The flowchart of FIG. 15 illustrates an exemplary process 160 for constructing a building 92 with an elevator system 20. At block 162, a hoistway 22, 26 for the elevator system 20 is installed within two adjacent levels 82, 84 of the building 92. A stationary part 54 of a linear permanent magnet motor is installed within the hoistway 22, 26 at block 164. An elevator car 24 is placed within the hoistway 22, 26 at block 166. At block 168, a moving part 52 of the linear permanent magnet motor is mounted on the elevator car 24. At block 170, the stationary and moving parts 52, 54 of the linear permanent magnet motor are used to generate a vertical thrust force to move the elevator car 24 within the hoistway 22, 26, with the elevator car 24 carrying passengers, equipment, and/or materials for construction of upper levels of the elevator system 20 and building 92.

Figure 16:
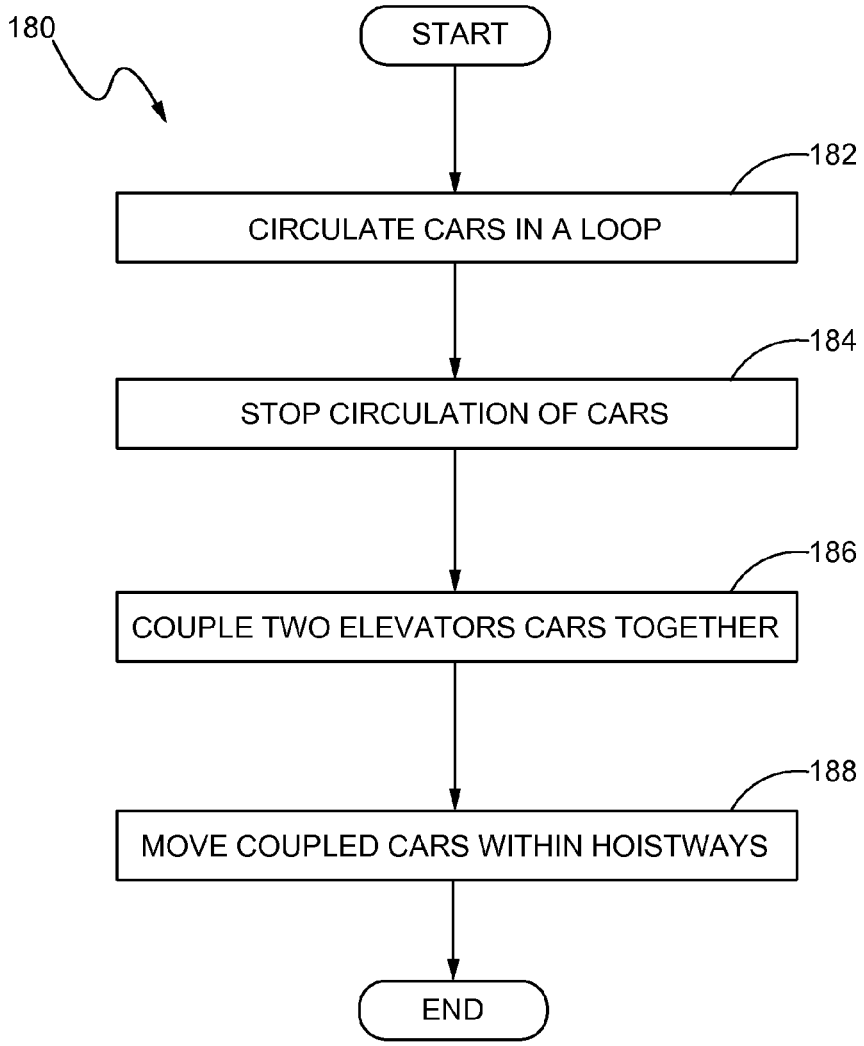
FIG. 16 is a flowchart illustrating an exemplary process for operating a ropeless elevator system in an exemplary embodiment.

The flowchart of FIG. 16 illustrates another exemplary process 180 for operating a ropeless elevator system 100, the ropeless elevator system 100 including a first hoistway 22, a second hoistway 26, an upper transfer station 34 positioned above the first and second hoistways 22, 26, and a lower transfer station 36 positioned below the first and second hoistways 22, 26. At block 182, a plurality of elevator cars are circulated in a loop around the first hoistway 22, the upper transfer station 34, the second hoistway 26, and the lower transfer station 36. The circulation of the elevator cars in the loop is stopped at block 184. Two elevator cars 102, 104 are coupled together at block 186. At block 188, the coupled elevator cars are moved upwards or downwards within the first and second hoistways 22, 26.

It is to be understood that the blocks in the flowcharts illustrated in FIGS. 15 and 16 may be performed in a different order than that shown. For example, in reference to the exemplary process 160 of FIG. 15, the order of block 166 and block 168 may be switched. A moving part 52 of the propulsion system 50 may be mounted on the elevator car 24 before the elevator car 24 is placed within the hoistway 22, 26.

By using the elevator systems and methods disclosed herein, immense time and cost savings are achieved when constructing an elevator system and a building containing the elevator system. The disclosed elevator system can be used upon installation of two levels within a partially constructed building to carry passengers and cargo. An elevator motor does not need to be installed at a top of the building. As a result, construction workers do not have to wait until the entire elevator system is finally constructed in order to use the elevator system. The disclosed elevator system facilitates the quick construction of its own system as well as the building, carrying equipment and materials to upper levels without requiring the use of a crane. The coupled elevator cars, cargo car, and extended propulsion systems of the disclosed elevator system create a larger capacity elevator for lifting larger and heavier loads. Furthermore, the moving part, stationary part, and hoistways installed for construction use in the building may be the permanent structures of a final construction of the elevator system.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto.

While some features are described in conjunction with certain specific embodiments of the invention, these features are not limited to use with only the embodiment with which they are described, but instead may be used together with or separate from, other features disclosed in conjunction with alternate embodiments of the invention.

What is claimed is:

1. A method for constructing a building with an elevator system, the method comprising:

forming a first hoistway for the elevator system within two adjacent levels of the building;

installing a first stationary part of a first linear permanent magnet motor within the first hoistway;

placing a first elevator car within the first hoistway;

mounting a first moving part of the first linear permanent magnet motor on the first elevator car;

using the first stationary part and the first moving part of the first linear permanent magnet motor to generate a vertical thrust force to move the first elevator car within the first hoistway, the first elevator car carrying at least one of passengers, equipment and materials for construction of upper levels of the elevator system and the building forming a second hoistway for the elevator system next to, and distinct from, the first hoistway;

installing a second stationary part of a second linear permanent magnet motor within the second hoistway;

mounting a second moving part of the second linear permanent magnet motor on the second elevator car;

placing a second elevator car within the second hoistway; and coupling the first and second elevator cars together such that they share an interior compartment, wherein the first coupled elevator car is located within the first hoistway and the first coupled elevator car is programed to move upwards and downwards within the first hoistway, and wherein the second coupled elevator car is located within the second hoistway and the second coupled elevator car is programed to move upwards and downwards within the second hoistway.

2. The method of claim 1, wherein the carrying at least one of passengers, equipment and materials for construction of upper levels of the elevator system and the building is performed prior to a final construction of the elevator system.

3. The method of claim 1, further comprising installing an oversized elevator car in the first and second hoistways, and utilizing the first and second linear permanent magnet motors to provide a thrust force to move the oversized elevator car vertically within the first and second hoistways.

4. The method of claim 1, further comprising utilizing a plurality of elevator cars within the first hoistway.

5. The method of claim 1, further comprising utilizing a top or bottom surface of the first elevator car to transport loads within the first hoistway.

6. A ropeless elevator system, comprising:

a first elevator hoistway;

a second elevator hoistway;

an upper transfer station positioned at or above a top level of the first and second hoistways;

a lower transfer station positioned at or below a bottom level of the first and second hoistways;

a plurality of elevator cars configured to travel in at least one of the first and second elevator hoistways, wherein each of the plurality of elevator cars includes a control unit; and an elevator propulsion system comprising:

at least one first stationary portion positioned in the first elevator hoistway, at least one second stationary portion positioned in the second elevator hoistway, and a plurality of moving portions, the plurality of moving portions being selectively operatively connected to the plurality of elevator cars, wherein the plurality of moving portions selectively operatively connected to the plurality of elevator cars interact with at least one of the first and second stationary portions to provide a motive force to move the plurality of elevator cars within at least one of the first and second elevator hoistways, wherein at least two of the plurality of elevator cars are operatively connected to each other such that the moving portions selectively operatively connected to the at least two of the plurality of elevator cars are provided a combined motive force by the moving portions selectively operatively connected thereto, wherein the control units of the plurality of elevator cars are programmed to operate the plurality of elevator cars within a loop when the plurality of elevator cars are not operatively connected to each other, wherein the loop includes the first hoistway, the upper transfer station, the second hoistway, and the lower transfer station, wherein the control units of the plurality of elevator cars are programmed to operate the plurality of elevator cars bi-directionally within the first and second hoistways when the at least two of the plurality of elevator cars are operatively connected to each other, wherein at least a first and second car of the at least two of the plurality of elevator cars are coupled to one and other when the at least two of the plurality of elevator cars are operatively connected to each other, wherein the control unit of the first car is programed to operate the first car bidirectionally within the first hoistway when the first car is coupled to the second car, and wherein the control unit of the second car is programed to operate the second car bidirectionally within the second hoistway when the first car is coupled to the second car.

7. The ropeless elevator system of claim 6, wherein the moving portions selectively operatively connected to the at least two of the plurality of elevator cars operatively connected to each other are synchronized with each other in order to move the elevator cars at a same speed and direction.

8. The ropeless elevator system of claim 6, further comprising an oversized elevator car that is larger than the first elevator car or the second elevator car, and wherein the elevator propulsion system includes moving portions selectively operatively connected to the oversized elevator car.

9. The ropeless elevator system of claim 8, wherein the interaction of the moving portions selectively operatively connected to the oversized elevator car and the stationary portions positioned in the first and second hoistways generate a thrust force to move the oversized elevator car in a vertical direction within the first and second hoistways.

10. The ropeless elevator system of claim 6, further comprising extended moving portions selectively operatively connected to the at least two of the plurality of elevator cars operatively connected to each other, which generate a greater thrust force to support an increased weight load of the elevator cars connected to each other.

11. A method for operating a ropeless elevator system, the ropeless elevator system including a first hoistway, a second hoistway, an upper transfer station positioned above the first and second hoistways, and a lower transfer station positioned below the first and second hoistways, the method comprising:

circulating a plurality of elevator cars in a loop around the first hoistway, the upper transfer station, the second hoistway, and the lower transfer station;

stopping circulation of the plurality of elevator cars in the loop;

coupling two elevator cars together, wherein a first coupled elevator car of the two coupled elevator cars is within the first hoistway, wherein a second coupled elevator car of the two coupled elevator cars is within the second hoistway; and moving the coupled elevator cars upwards or downwards within the first and second hoistways, wherein the first coupled elevator car moves within the first hoistway, and wherein the second coupled elevator car moves within the second hoistway.

12. The method of claim 11, further comprising synchronizing motors of the coupled elevator cars together such that the coupled elevator cars move at a same speed and direction.

13. The method of claim 11, further comprising inserting a cargo car within the first and second hoistways, the cargo car having a size that is greater than a size of one elevator car; and moving the cargo car upwards or downwards within the first and second hoistways.

14. The method of claim 11, further comprising extending a moving part of a propulsion system to generate a greater thrust force to support an increased weight load of the coupled elevator cars.

* * * * *